US011378257B2

(12) United States Patent
Potucek et al.

(10) Patent No.: US 11,378,257 B2
(45) **Date of Patent: *Jul. 5, 2022**

(54) LOW-PROFILE NICHE FOR UNDERWATER POOL/SPA LIGHTS

(71) Applicant: Hayward Industries, Inc., Berkeley Heights, NJ (US)

(72) Inventors: Kevin Potucek, Naples, FL (US); Carl Davidson, Mocksville, NC (US); Alan Levin, Bermuda Run, NC (US); Gregory Fournier, West Kingston, RI (US)

(73) Assignee: Hayward Industries, Inc., Berkeley Heights, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/196,684

(22) Filed: Mar. 9, 2021

(65) Prior Publication Data

US 2021/0190297 A1 Jun. 24, 2021

Related U.S. Application Data

(63) Continuation of application No. 14/727,030, filed on Jun. 1, 2015, now Pat. No. 10,941,920, which is a (Continued)

(51) Int. Cl.
*F21V 15/01* (2006.01)
*F21V 27/02* (2006.01)
(Continued)

(52) U.S. Cl.
CPC ..... *F21V 15/01* (2013.01); *F21V 27/02* (2013.01); *F21V 17/12* (2013.01); *F21V 17/16* (2013.01);
(Continued)

(58) Field of Classification Search
CPC ..... F21W 2131/401; F21V 15/01; F21V 19/0045; F21V 19/004; F21V 19/003;
(Continued)

(56) References Cited

U.S. PATENT DOCUMENTS 1,054,747 A 3/1913 Christian
1,678,137 A 7/1928 Douglas
(Continued)

OTHER PUBLICATIONS

PowerPoint Presentation entitled "Lighting," dated Oct. 3, 2011 (15 pages).

(Continued)

*Primary Examiner* — Jong-Suk (James) Lee
*Assistant Examiner* — James M Endo
(74) *Attorney, Agent, or Firm* — McCarter & English, LLP

(57) ABSTRACT

A niche for a pool or spa light includes a back wall having an aperture for a power cable, a side wall, a plurality of mounting ribs, and means for receiving a locking mechanism of a pool or a spa light for locking the pool or spa light in position with respect to the niche. In another embodiment, a niche for a pool or spa light includes a body and a rotatable hub with a plurality of mounting ribs for attaching a pool or spa light to the hub. The body includes a back wall having a power cable aperture and a threaded aperture for receiving a screw, and a side wall. The hub includes a back wall having an aperture for receiving the screw and a plurality of mounting ribs, the hub being rotatable about the screw.

23 Claims, 11 Drawing Sheets

Related U.S. Application Data continuation of application No. 13/573,708, filed on Oct. 3, 2012, now Pat. No. 9,046,247.

(51) Int. Cl.

| | |
|---|---|
| ***F21V 19/00*** | (2006.01) |
| ***F21W 131/401*** | (2006.01) |
| ***F21V 17/16*** | (2006.01) |
| ***F21V 17/12*** | (2006.01) |

(52) U.S. Cl.

CPC ..... *F21V 17/164* (2013.01); *F21V 19/0045* (2013.01); *F21W 2131/401* (2013.01)

(58) Field of Classification Search

CPC ..... F21V 19/06; F21V 17/18; F21V 17/104; F21V 17/14; F21V 17/16; F21V 17/164; F21V 17/06; F21V 17/10; F21V 17/04; F21V 17/162; F21V 17/166; F21V 17/12; F21V 17/005; F21V 17/107; F21V 21/04; F21V 21/046; F21V 21/044; F21V 31/00; F21V 31/005

See application file for complete search history.

(56) References Cited

U.S. PATENT DOCUMENTS

| | | | |
|---|---|---|---|
| 1,711,264 | A | 4/1929 | Doane |
| 2,518,936 | A | 8/1950 | Roberts |
| 2,781,737 | A | 2/1957 | Killman |
| 4,053,758 | A | 10/1977 | Shaw |
| 4,574,337 | A | 3/1986 | Poppenheimer |
| 4,656,689 | A | 4/1987 | Dennis |
| 4,999,757 | A | 3/1991 | Poppenheimer |
| 5,075,831 | A | 12/1991 | Stringer et al. |
| 5,349,505 | A | 9/1994 | Poppenheimer |
| 5,394,316 | A | 2/1995 | Holbrook et al. |
| 5,432,688 | A | 7/1995 | Tobias et al. |
| 5,465,199 | A | 11/1995 | Bray et al. |
| 5,556,188 | A | 9/1996 | Poppenheimer |
| 5,567,041 | A | 10/1996 | Slocum |
| 5,607,224 | A | 3/1997 | Tobias et al. |
| 5,758,958 | A | 6/1998 | Chen |
| 5,836,678 | A | 11/1998 | Wright et al. |
| 6,068,384 | A | 5/2000 | Tyson et al. |
| 6,152,571 | A | 11/2000 | Ruiz |
| 6,203,173 | B1 | 3/2001 | Duff et al. |
| 6,241,361 | B1 | 6/2001 | Thrasher et al. |
| 6,382,818 | B1 | 5/2002 | Iwama et al. |
| 6,669,351 | B1 | 12/2003 | Shea et al. |
| 6,899,445 | B2 | 5/2005 | Hyder |
| 6,940,016 | B1 | 9/2005 | Cornett et al. |
| 7,320,536 | B2 | 1/2008 | Petrakis et al. |
| 7,705,240 | B2 | 4/2010 | Armstrong et al. |
| 7,947,903 | B2 | 5/2011 | Peck |
| 9,046,247 | B2 | 6/2015 | Potucek et al. |
| 9,392,711 | B2 | 7/2016 | Potucek et al. |
| 10,941,920 | B2 | 3/2021 | Potucek et al. |
| 2005/0237746 | A1 | 10/2005 | Yiu |
| 2006/0002104 | A1 | 1/2006 | Willis et al. |
| 2006/0072323 | A1 | 4/2006 | Poggi |
| 2006/0262462 | A1 | 11/2006 | Barton |
| 2007/0058374 | A1 | 3/2007 | Dupre |
| 2007/0147052 | A1 | 6/2007 | Wyatt |
| 2008/0112157 | A1 | 5/2008 | Boothe et al. |
| 2008/0273330 | A1 | 11/2008 | Tyson |
| 2010/0127637 | A1 | 5/2010 | Alexander et al. |
| 2011/0222268 | A1 | 9/2011 | Pearson et al. |
| 2012/0106149 | A1 | 5/2012 | Boa |
| 2012/0162999 | A1 | 6/2012 | Dupre |
| 2013/0039037 | A1* | 2/2013 | Drury ..... F21V 21/04 362/101 |
| 2014/0090865 | A1 | 4/2014 | Potucek et al. |
| 2014/0092606 | A1 | 4/2014 | Potucek et al. |
| 2015/0260375 | A1 | 9/2015 | Potucek et al. |

OTHER PUBLICATIONS

Pentair GLOBRITE Color Changing LED Pool/Spa Light Installation and User's Guide, Sep. 2012 (25 pages).

Office Action dated May 8, 2014 from U.S. Appl. No. 13/573,708 (25 pages).

Notice of Allowance dated Jan. 28, 2015 from U.S. Appl. No. 13/573,708 (8 pages).

Office Action dated May 17, 2017, issued in connection with U.S. Appl. No. 14/727,030 (21 pages).

Applicant Intiated Interview Summary dated Nov. 29, 2017, issued in connection with U.S. Appl. No. 14/727,030 (9 pages).

Office Action dated Mar. 7, 2018, issued in connection with U.S. Appl. No. 14/727,030 (29 pages).

Office Action dated Oct. 30, 2018, issued in connection with U.S. Appl. No. 14/727,030 (27 pages).

Office Action dated Sep. 27, 2019, issued in connection with U.S. Appl. No. 14/727,030 (21 pages).

Office Action dated Mar. 30, 2020, issued in connection with U.S. Appl. No. 14/727,030 (25 pages).

Notice of Allowance dated Oct. 30, 2020, issued in connection with U.S. Appl. No. 14/727,030 (10 pages).

* cited by examiner

LOW-PROFILE NICHE FOR UNDERWATER POOL/SPA LIGHTS

RELATED APPLICATIONS

The present application is a continuation of U.S. patent application Ser. No. 14/727,030 filed on Jun. 1, 2015 (now issued U.S. Pat. No. 10,941,920), which is a continuation application of and claims the benefit of priority to U.S. patent application Ser. No. 13/573,708 filed on Oct. 3, 2012 (now issued U.S. Pat. No. 9,046,247), the entire disclosures of which are both expressly incorporated by reference herein.

BACKGROUND OF THE INVENTION

Field of the Invention

The present invention relates to a niche for an underwater light, and more specifically to a low-profile niche for underwater pool/spa lights.

Related Art

Light niches used for gunite pools are conventionally deep bowls that require a steel rebar cage and considerable gunite surrounding the niche to reinforce the concrete bordering the void created in the wall. Both the cage and the extra gunite add considerable expense to the installation of these light niches. Additionally, these niches generally include metal components for capturing the niche, as well as metal components for bonding and ground of the niche, and a subsequent bond and/or ground of the light in the niche by virtue of the electrical connectivity of metal components in the light and niche. These components add expense to the niche due to the material used, as well as the necessity for bonding or grounding (which requires additional labor).

Further, underwater lights typically have a specific installation orientation, wherein the light "top" is installed at the 12:00 position and the niche "top" is also installed at the 12:00 position. This specific orientation forces the conduit exit of the niche (e.g., for electrical cabling of the light) to always be oriented at the same position relative to the "top" of the light, thus limiting the versatility of installation and preventing installation of the niche at different orientations relative to the "top" of the light. In doing so, a conduit trench must always be provided extending from the "top" of the niche and the light to accommodate the conduit exit. Moreover, if a niche incorrectly installed at a position other than the 12:00 position, the light will also be oriented at a position other than the 12:00 position, since the light does not rotate with respect to the niche. This can lead to visually unpleasing results.

Still further, existing niches do not provide a quick and convenient way for allowing secure installation of a light into a niche without using tools, such as screwdrivers or other tools. As such, not only must installers know how to properly install underwater lights into niches, but they must also carry tools with them into a pool or spa to install such lights.

SUMMARY

The present disclosure relates to a niche for a pool or spa light. In one embodiment, the niche includes a back wall having an aperture for receiving a power cable, a side wall, a plurality of mounting ribs, and a groove. The side wall is attached at one end about the periphery of the back wall, and a plurality of mounting ribs are attached to an inner surface of the side wall. The groove is formed in at least one of the plurality of mounting ribs, and receives a locking mechanism of a pool or a spa light for locking the pool or spa light in position with respect to the niche. The light can be quickly and conveniently installed into the niche without requiring the use of tools, using a simple "twist-and-lock" motion to lock the light into place in the niche. The light is attached to the niche by a locking mechanism on the light that is configured to engage the plurality of mounting ribs. The locking mechanism includes a body connected to the light, a stopper configured to engage the plurality of mounting ribs, and a flexible arm including a first end connected to the body and a second end connected to an engagement head. The engagement head contacts the plurality of mounting ribs and flexes the flexible arm when the light is rotated in the niche, such that the engagement head passes over the groove and releasably engages the mounting rib.

In another embodiment, a niche for a pool or spa light includes a body and a rotatable hub which includes a plurality of mounting ribs attached to the inner surface of the side wall of the hub, for receiving a pool or spa light and locking the light into position within the hub using a "twist-and-lock" motion. The body includes a back wall having an aperture for receiving a power cable and a threaded aperture for receiving a screw, and a side wall attached at one end about the periphery of the back wall. The hub includes a back wall having an aperture for receiving a screw, such that the hub is rotatable about the screw. A groove is formed in at least one of the plurality of mounting ribs for receiving a locking mechanism of a pool or a spa light, for locking the pool or spa light in position with respect to the niche. The screw is insertable through the aperture of the hub and is received by a threaded aperture of the body to secure the hub to the body. The hub can be rotated with respect to the niche so that the light can be oriented to the 12:00 (upright) position, regardless of the angle at which the niche is installed in a pool or a spa.

BRIEF DESCRIPTION OF THE DRAWINGS

The foregoing features of the invention will be apparent from the following Detailed Description of the Invention, taken in connection with the accompanying drawings, in which.

DETAILED DESCRIPTION

The present disclosure relates to a low-profile niche for underwater pool/spa lights, as discussed in detail below in connection with FIGS. 1A-9.

Figure 1A:
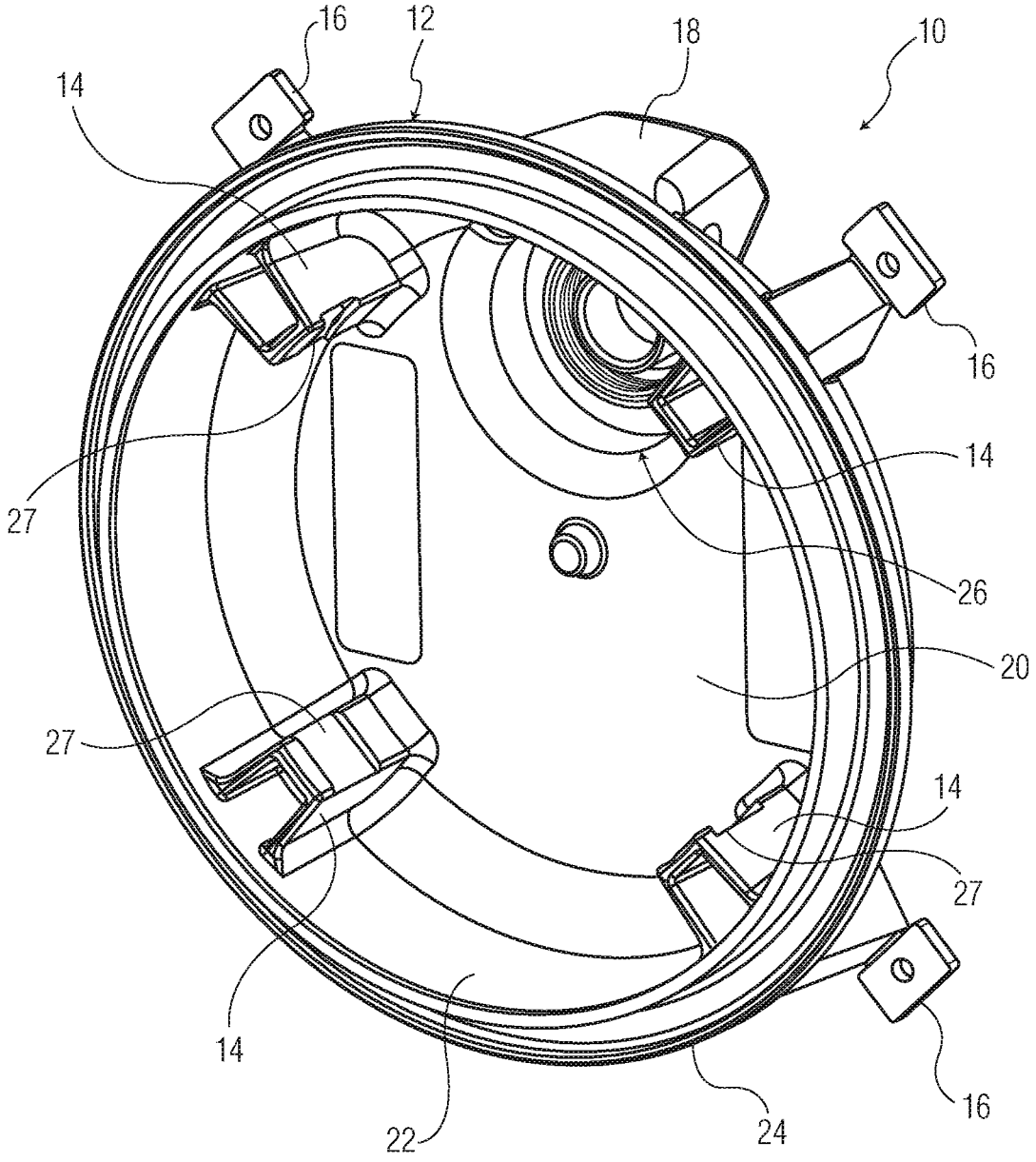
FIG. 1A is a front perspective view of the low-profile niche of the present disclosure.
Figure 1B:
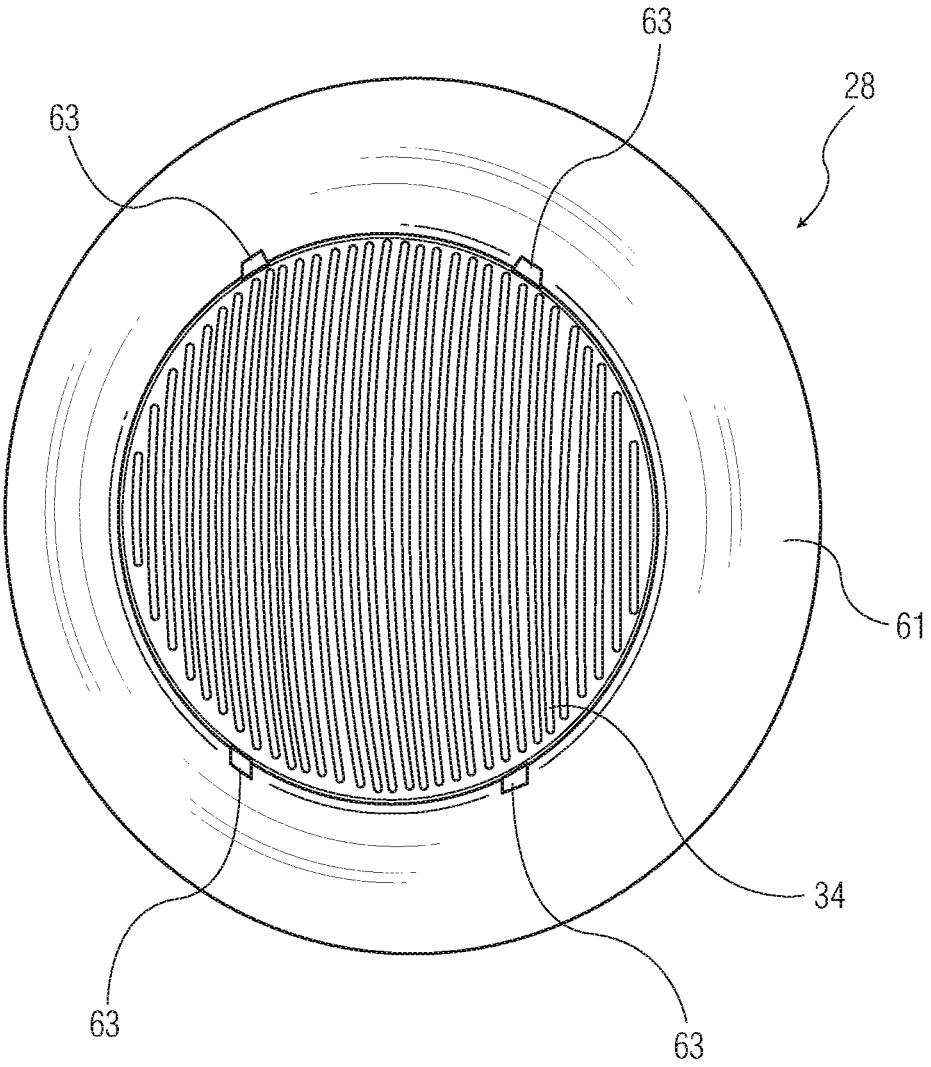
FIG. 1B is a front perspective view of an underwater pool or spa light configured to connect to the niche of FIG. 1A.
Figure 1C:
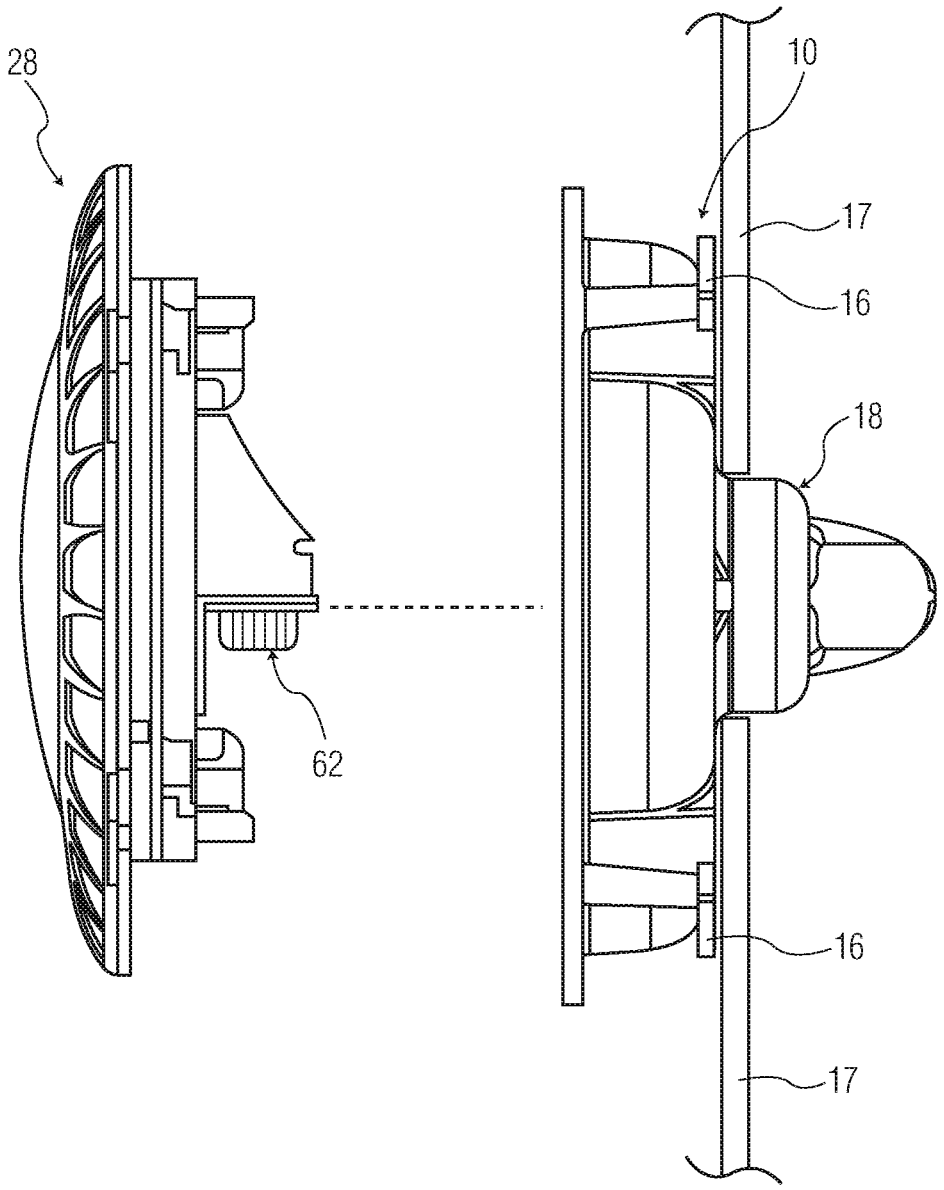
FIG. 1C is a side exploded view of the niche of FIG. 1A and the light of FIG. 1B.

FIG. 1A is a perspective view of a low-profile niche according to the present disclosure. The low-profile niche 10 includes a body 12, a plurality of mounting ribs 14, a plurality of niche mounting brackets 16, and an angled conduit hub 18. The body 12 includes a rear wall 20, a side wall 22, and a radial flange 24. The rear wall 20 is connected to the side wall 22 to form a low-profile compartment that houses an underwater pool or spa light when it is connected to the niche 10. The side wall 22 generally has a lower depth when compared to standard underwater light niches, so that the entire niche 10 can be installed in the wall of a pool or spa so that the rear wall 20 does not protrude through the plane or planes created by the steel rebar grid of a pool or spa. The mounting brackets 16 can be tied to the rebar grid of the pool or spa to secure the niche 10 to the pool or spa rebar grid, and then concrete (gunite) can be sprayed on the rebar grid after the niche 10 is installed.

The rear wall 20 includes a conduit aperture 26 that provides access to the angled conduit hub 18 mounted to the exterior of the rear wall 20. The conduit aperture 26 allows for a power/control cable of a light to extend through the rear wall 20 and into the angled conduit hub 18. The angled conduit hub 18 is generally provided at a 45° angle, and may be connected to a conduit pipe having a 45° bend. As such, the conduit of the light may bend a full 90° and run parallel to the face of the niche installation. The angled conduit hub 18 may be a separate piece that is attached/mounted to the exterior of the rear wall 20, or, alternatively, may be a formed as a part of the body 12 extending from the rear wall 20. The low profile side wall 22, along with the angled conduit hub 18, allows the conduit to travel away from the niche 10 parallel to the plane of the rear wall 20. A cord seal could be provided in the conduit hub 18 to prevent ingress of water through the hub 18.

Figure 2:
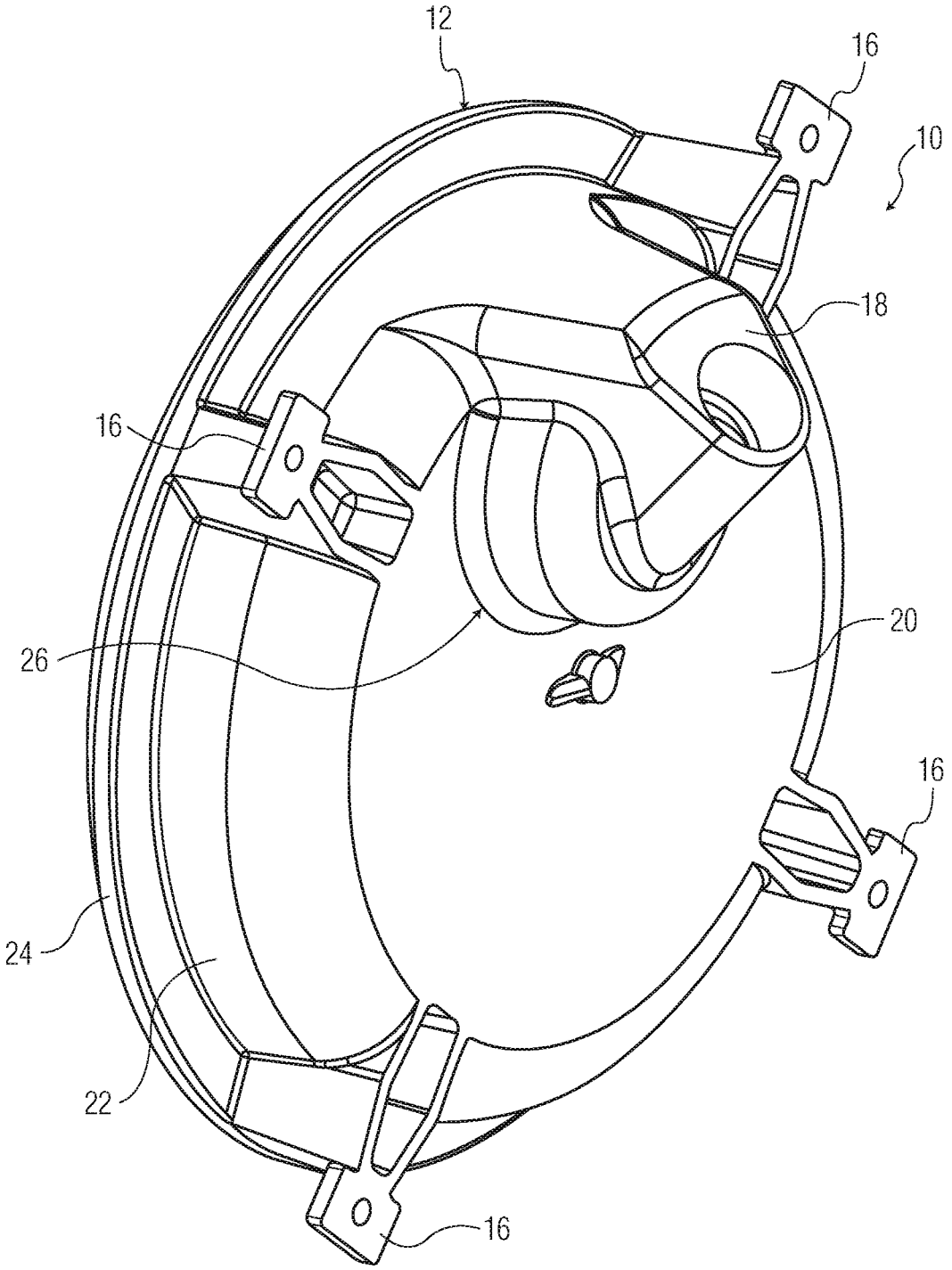
FIG. 2 is a rear perspective view of the niche of FIG. 1.
Figure 3:
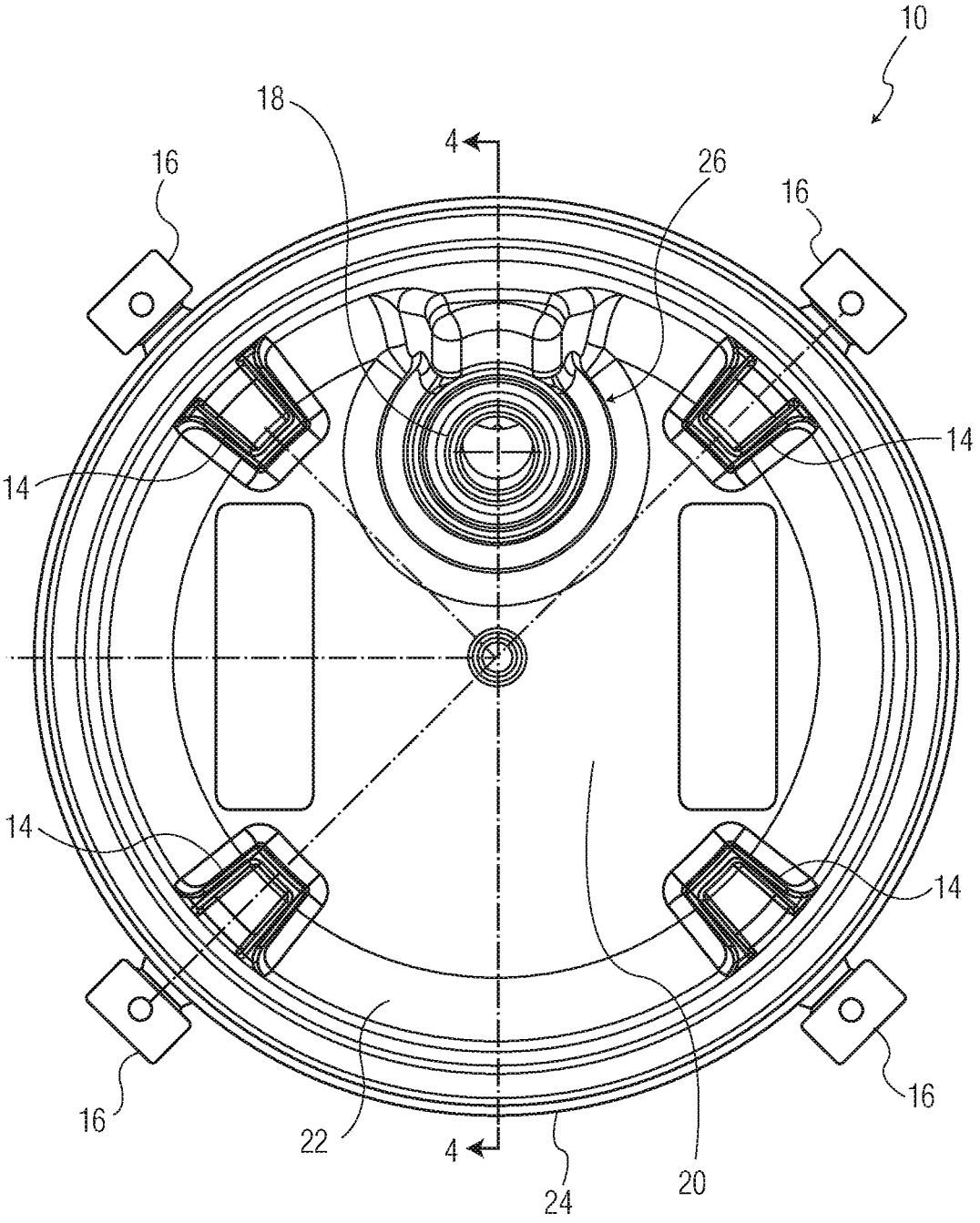
FIG. 3 is a front view of the low-profile niche of FIG. 1.
Figure 4:
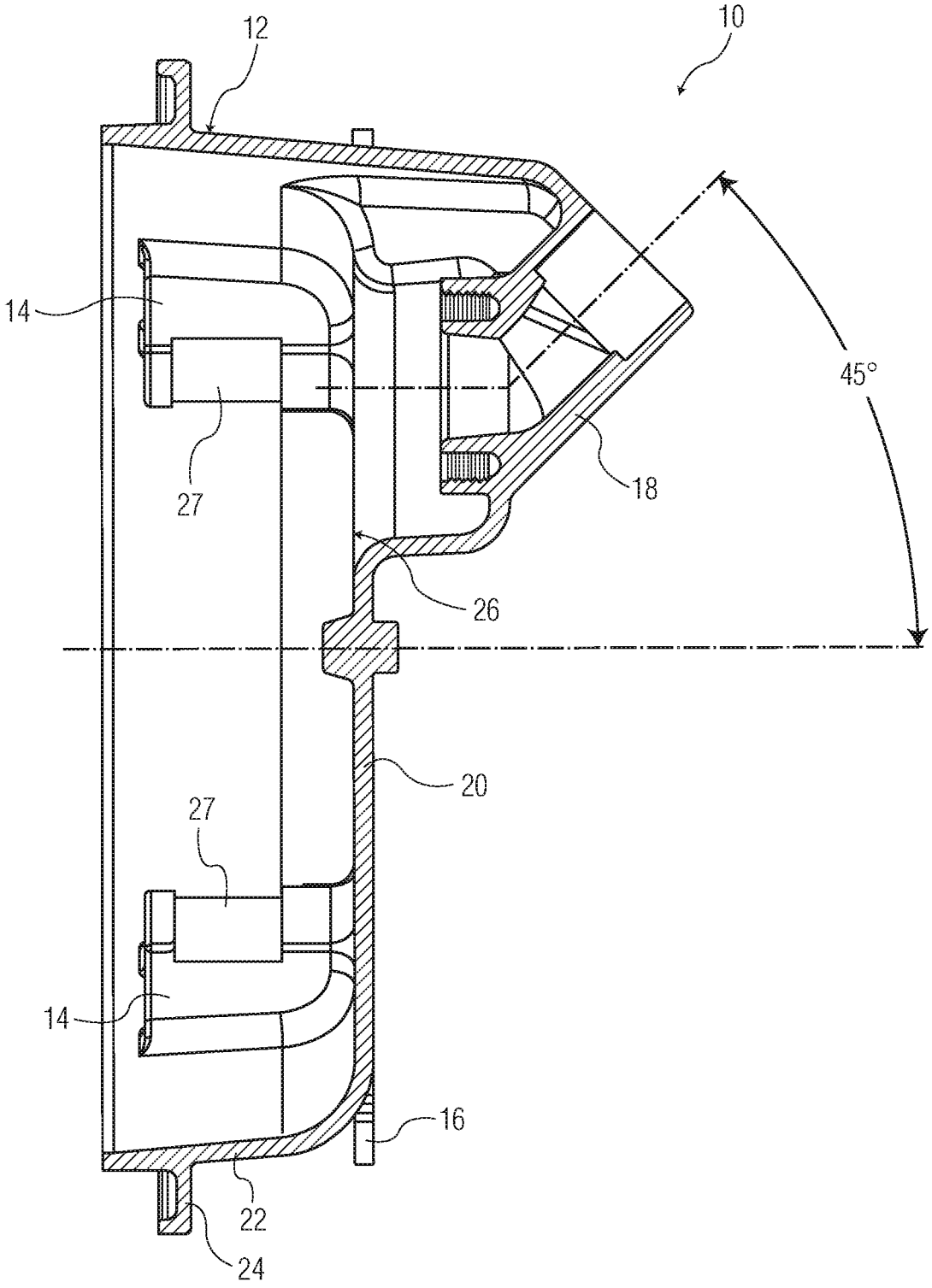
FIG. 4 is a cross-sectional view of the low-profile niche taken along line 4-4 of FIG. 3.
Figure 5:
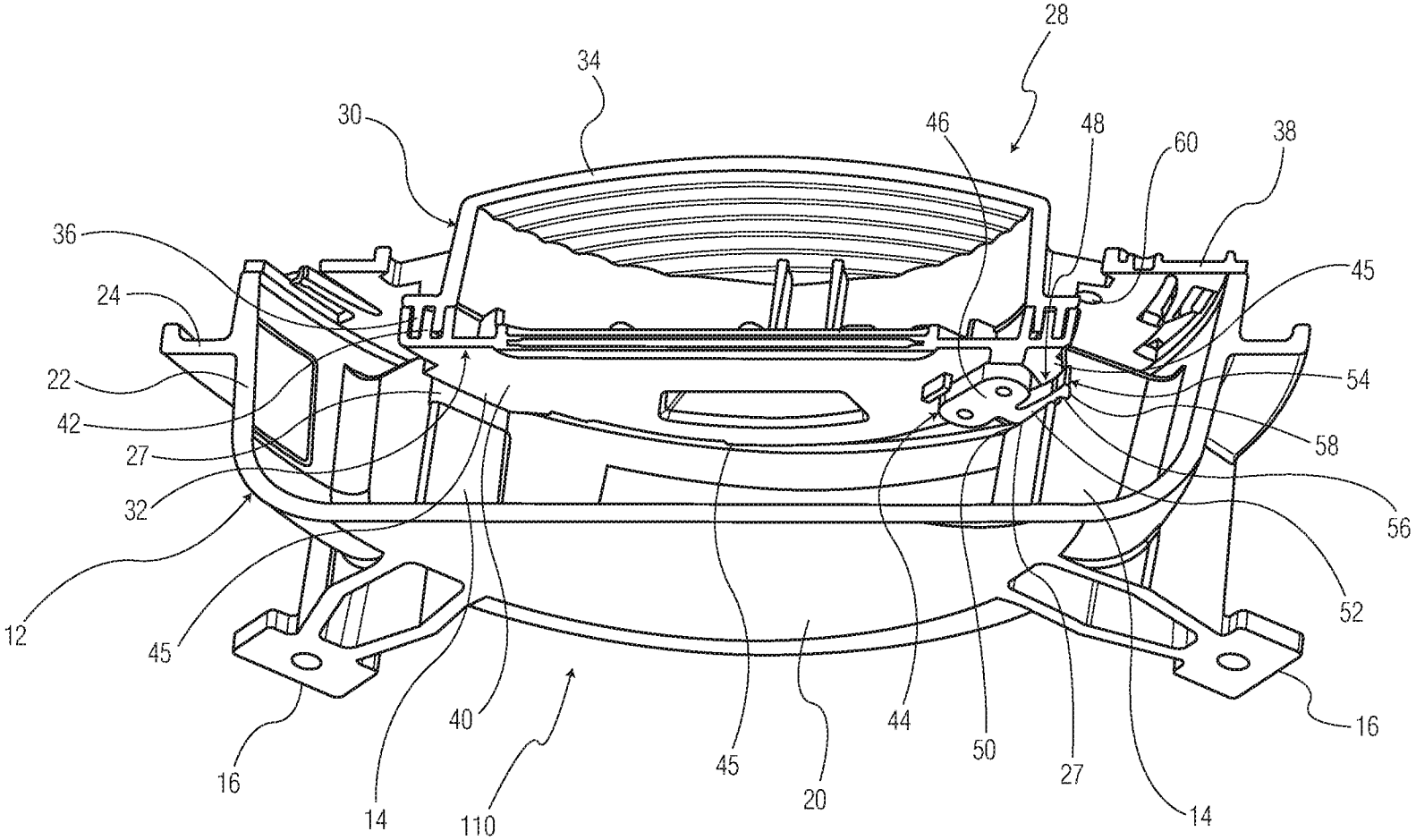
FIG. 5 is a cross-sectional view of the low-profile niche of FIG. 1 with a light secured thereto.
Figure 6:
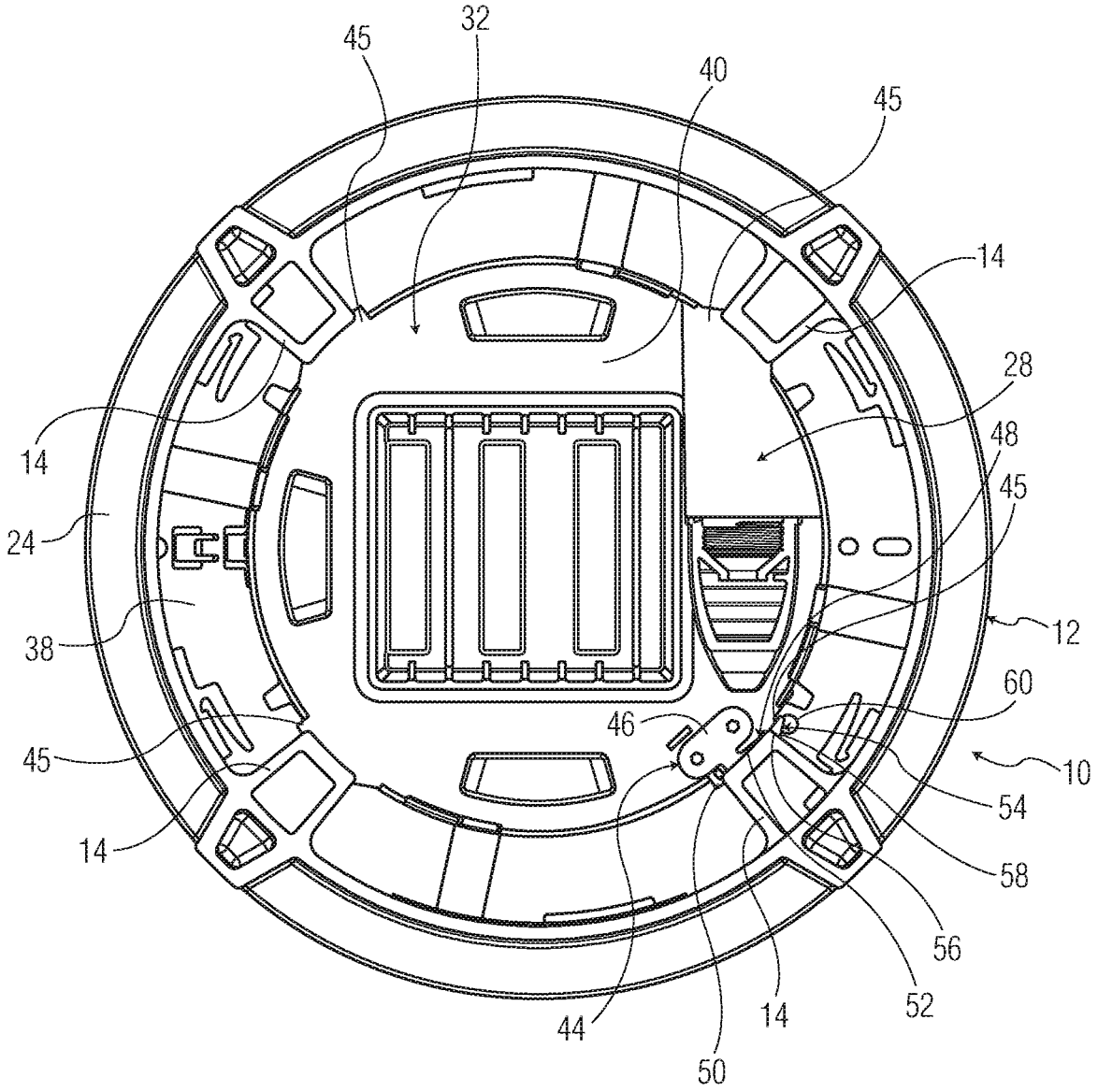
FIG. 6 is a cross-sectional view of the low-profile niche and light combination of FIG. 5, taken at a plane parallel to the rear wall of the niche and at a point along the sidewall looking toward the rear housing of the light.

The plurality of niche mounting brackets 16 extend from the body 12 so that the body 12 can be mounted to the pool wall. The mounting brackets 16 may be connected to the body 12, or may be formed as a part of the body 12. Four mounting brackets 16 are illustrated in FIGS. 1-3, however, any desired number of brackets can be provided.

As shown in FIGS. 1A-6, the radial flange 24 extends radially from a forward portion of the side wall 22. The radial flange 24 provides a surface on the niche 10 for gunite to adhere to when patching the pool wall during installation of the niche 10. It is noted that the niche 10 can be formed entirely from a non-conductive material, such as plastic. With specific reference to FIG. 1C, it can be seen that, when the niche 10 is attached to a rebar grid 17 of a pool or a spa (prior to spraying gunite to form the pool or spa walls and other surfaces), the conduit hub 18 of the light extends past the rebar grid 17, but the remainder of the niche 10 does not. Advantageously, such a configuration obviates the need for a pool/spa contractor to shape or re-work the rebar around the niche 10, as is required with conventional niches.

As shown in FIGS. 1A and 3-5, the light mounting ribs 14 are mounted on the inner surface of the side wall 22, and on the rear wall 20. The mounting ribs 14 include a lateral groove 27 extending a predefined depth into the mounting ribs 14 and across each mounting rib 14. The lateral grooves 27 allow a light to be mounted to the niche 10, as discussed in greater detail below.

As shown in FIGS. 1B, 1C, 5, and 6, the light 28 generally includes a front housing portion 30 and a rear housing portion 32. The front housing portion 30 includes a lens 34, an interlocking member 36, and a radial flange or bezel 38. The rear housing portion 32 includes a rear wall 40 and an interlocking member 42. The interlocking member 36 of the front housing portion 30 interlocks with the interlocking member 42 of the rear wall 40 so that the front housing portion 30 and the rear housing portion 32 can be interconnected in a water-tight arrangement. A sealing material may be disposed between the interlocking members 36, 42 so that the light 28 is sealed. The radial flange 38 extends radially from front housing 30 and is provided so that when the light 28 is placed in the niche 10, it contacts a front face of the side wall 22. The light 28 further includes a locking mechanism 44 attached to the exterior of the rear wall 40 of the rear housing 32, and four locking tabs 45 extending radially from the rear wall 40 located at approximately equidistant positions along the circumference of the rear wall 40. The locking mechanism 44 includes a body 46, a bendable tab 48, and a stopper 50. The bendable tab 48 includes a flexure arm 52 and an engagement head 54. The body 46 is secured to the rear wall 40 of the rear housing 32. The flexure arm 52 is connected to, and extends from, the body 46 generally along the circumference of the rear housing 32 such that the flexure arm can be flexed radially with respect to the rear housing 32, e.g., toward the center of the rear housing 32 and radially outwardly. The engagement head 54 is at the end of the flexure arm 52 opposite the end connected to the body 46. The engagement head 54 includes a flat face 56 and a slanted face 58. The height of the flexure arm 52 is less than the height of the lateral grooves 27, and the engagement head 54 slides along the lateral grooves 27. The stopper 50 extends radially from the end of the flexure arm 52, opposite the engagement head 54. The space between the stopper 50 and the flat face 56 of the engagement head 54 is slightly greater than the width of the mounting ribs 14, so that the mounting rib can be locked in position in the space between the stopper 50 and the flat face 56.

Once the light 28 is inserted into the niche 10, a user can rotate the light 28 clockwise such that the slanted face 58 of the engagement head 54 contacts the lateral groove 27 of one of the mounting ribs 14. This contact causes the flexure arm 52 to bend inward, allowing the light 28 to continue to be rotated clockwise with the engagement head 54, traversing the lateral groove 27. Once the engagement head 54 has traveled completely across the lateral groove 27, such that the flat face 56 has passed the lateral groove 27, the stopper 50 contacts a first sidewall of the mounting rib 14 and the flexure arm 52 returns to its unbiased position. In this position, the light 28 can no longer be rotated clockwise because of the stopper 50, and it cannot be rotated counter-clockwise because of the flat face 56 of the engagement head 54 contacting or being adjacent to a second sidewall of the mounting rib 14. Additionally, the light 28 cannot be pulled out of the niche 10 because the locking tabs 45 are seated in the lateral grooves 27.

The light 28 may include a hole or slot 60 disposed in and extending through the radial flange 38 of the light 28, to permit a pin or screwdriver to be inserted therein and to bend the flexure arm 52 radially inwardly so that the light 28 can be rotated counter-clockwise and the flexure arm 52, and the locking tabs 45, can be rotated out of the lateral grooves 27 without the flat face 56 of the engagement head 54 locking against the sidewall of the mounting rib 14. This allows the light 28 to be removed from the niche 10. As can be seen with reference to FIG. 1B, a trim plate 61 (or, bezel) could be provided on the light 28, to provide a pleasing aesthetic effect for the light. Moreover, the plate 61 functions to cover the apertures 60 in the flange 38, to prevent against undesired removal of the light 28 from the niche 10. However, slots 63 are provided on the plate 61 to allow insertion of a tool (e.g., a flat-blades screwdriver) to remove the plate 61, so that access can be gained to the apertures 60, to allow removal of the light 28.

Allowing the flexure arm 52 to lock with any one of the mounting ribs 14 allows a user flexibility in how the niche 10 is mounted to the pool wall. More specifically, a user may desire the niche 10 to mounted be to the pool wall such that the conduit aperture 26 and the angled conduit hub 18 are located at the 3:00 position, allowing the lighting conduit to travel away from the niche 10 parallel to the plane of the rear wall 20, thus alleviating the need for conduit trenches to be dug. However, the user may nonetheless wish for the "top" of the light 28 to be at the 12:00 position. In a standard niche, a user may have limited options for mounting the light to the niche. However, the niche 10 of FIGS. 1-6 allows a user to position the niche 10 as desired and then insert the light 28 so that it is locked in the desired orientation.

As mentioned above, the niche 10 of FIGS. 1-6 may be made entirely of a non-metallic components that do not conduct electricity. As such, the niche 10 does not require additional bonding to a pool wall and grounding. Further, the niche 10 may be constructed entirely of components that include no "dead metal" components, e.g., components that include a metal that has no means of electrical connectivity to other metal components, or no means of bonding or grounding.

Figure 7:
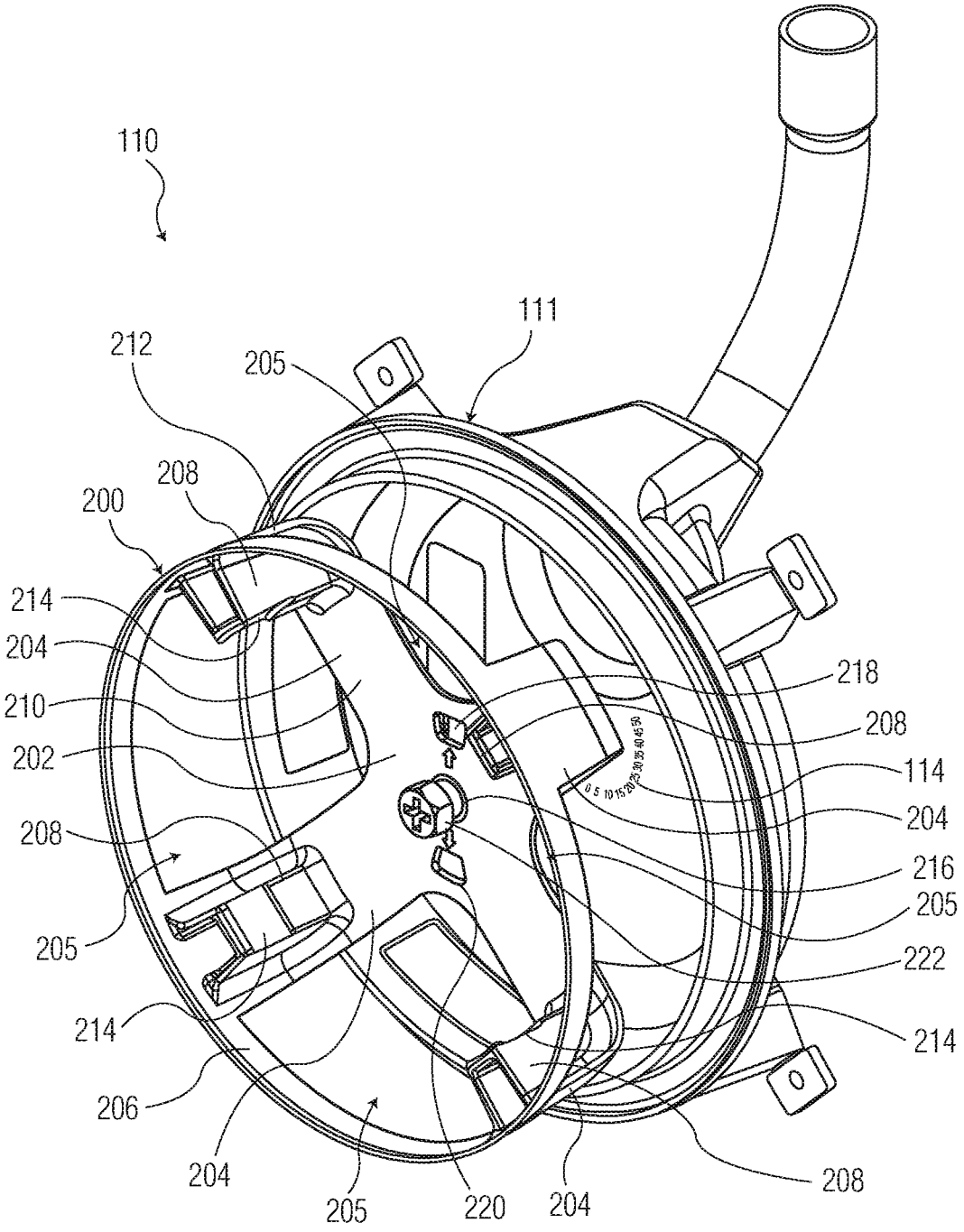
FIG. 7 is a semi-exploded, perspective view showing another embodiment of the low-profile niche of the present disclosure, which includes a rotatable hub.
Figure 8:
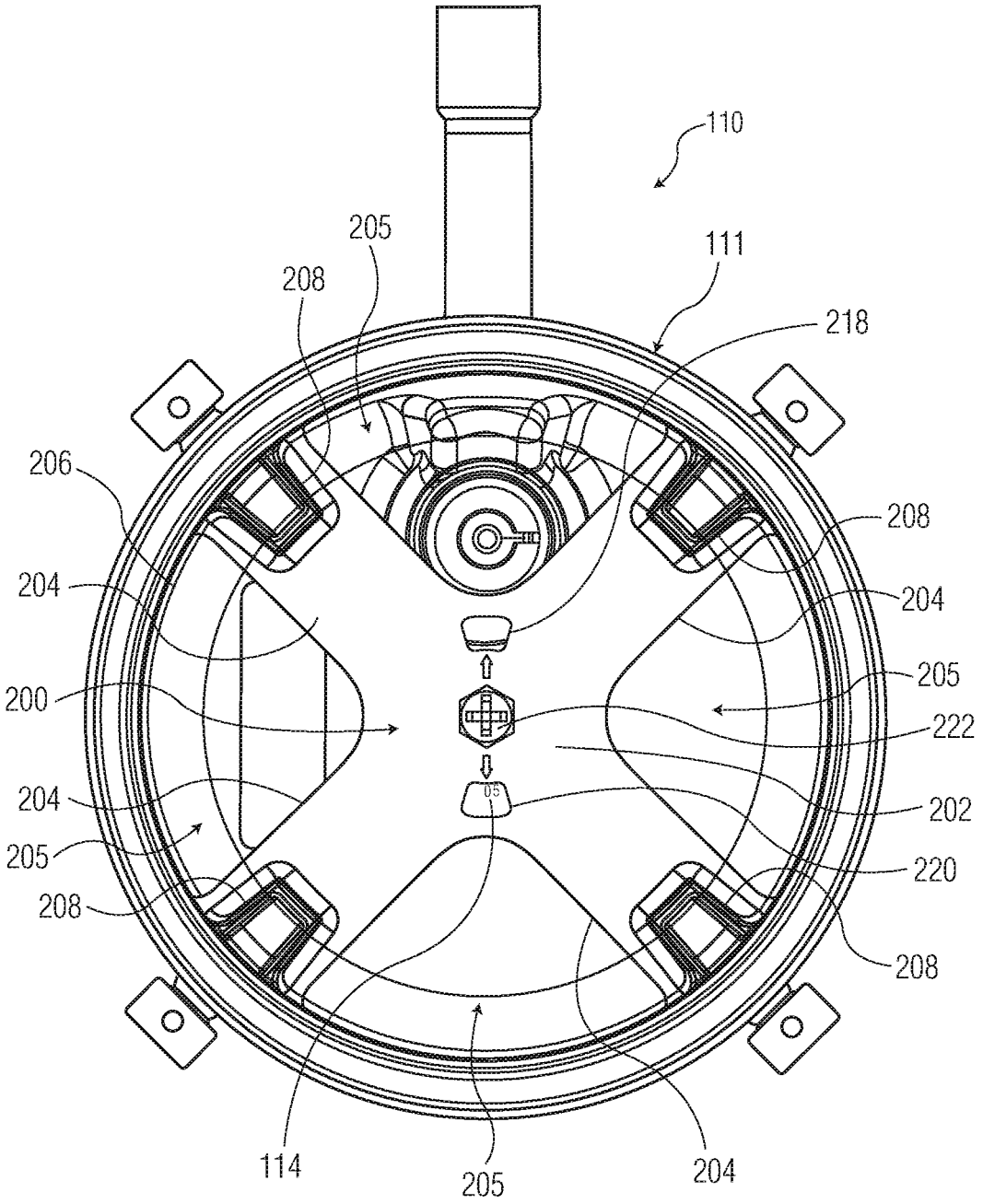
FIG. 8 is a front view of the low-profile niche of FIG. 7, showing the conduit hub of the niche mounted at the 12:00 position.
Figure 9:
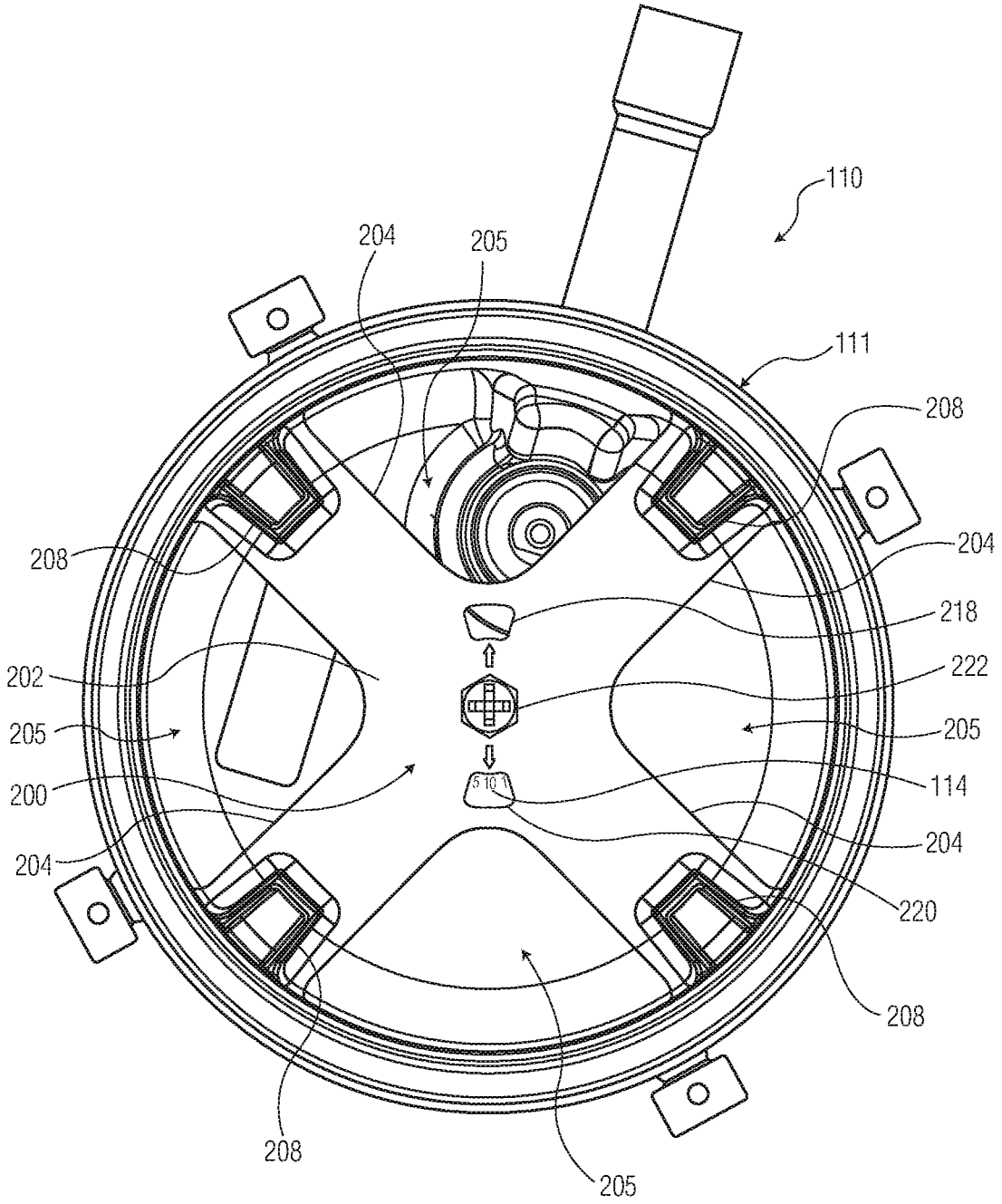
FIG. 9 is a front view of the low-profile niche of FIG. 7, showing the conduit hub of the niche mounted at a position 10° clockwise from the 12:00 position and the hub rotated to correct (compensate) for the 10° position of the niche.

FIGS. 7-9 illustrate another embodiment of the low-profile niche, which includes a rotatable and adjustable hub. The low-profile niche 110 is similar in structure to the niche 10 of FIGS. 1-6, with the exception that it does not include the mounting ribs 14 as internal structures to the niche. As such, the niche 110 functions nearly identical to the niche 10 of FIGS. 1-6, except the light cannot mount directly to the niche 110. Instead, the niche 110 includes a body 111 and a rotatable mounting hub 200 for mounting in the body 111 of the niche 110. The mounting hub 200 includes a central portion 202, four arms 204 disposed equidistantly about the central portion 202, a rim 206, and four light mounting ribs 208. The arms 204 are spaced by openings 205 and include a rear wall portion 210 and a side wall portion 212, wherein the rear wall portion 210 extends from the central portion 202 and the side wall portion 212 extends perpendicularly from the rear wall portion 210 to the rim 206. The rotatable mounting hub 200 is generally sized to fit the niche body 111 such that, when inserted, the face of the rim 206 is approximately coplanar with the front face of the niche body 111.

As shown in FIG. 7, the light mounting ribs 208 are mounted to the interior of the side wall portion 212 and the rear wall portion 210 of each arm 204. The mounting ribs 208 include a lateral groove 214 extending a predefined depth into the mounting ribs 208 and across the entirety of each mounting rib 208. The lateral grooves 214 allow a light to be mounted to the hub 200, as discussed above in connection with the mounting ribs 14 and lateral grooves 27 of FIGS. 1-6.

The hub 200 further includes a central aperture 216 and first and second windows 218, 220. The niche body 111 similarly includes a threaded central aperture 112. Furthermore, the niche body 111 includes a rotation guide 114 disposed rotationally about the central aperture 112 on the interior surface of a rear wall 116 of the niche body 111. As such, when the hub 200 is placed in the niche body 111, a screw 224 can be inserted through the central aperture 216 and into the threaded central aperture 222 so that the hub 200 can be secured to the niche body 111 when the screw 224 is adequately threaded into the threaded central aperture 222. When the hub 200 is secured to the niche body 111 the rotation guide 114 is viewable through either the first or second window 218, 220 of the hub 200, with the angle of the hub 200 being visible. Accordingly, a user may loosen the screw 224 so that the hub 200 can be rotated to a different angle, which may be determined by the user based upon the rotation guide 114.

As discussed above with regard to the light 28 of FIGS. 1-6, the light 28 can be attached to the hub 200 in an identical fashion. As such, a user would first secure the hub 200 to the niche body 111 at a desired angle, and then insert the light 28 and rotate it clockwise to lock the light 28 to the mounting ribs 208. The light conduit would extend through one of the openings 205, through the conduit aperture 118, into the angled conduit hub 120, and to a controller.

The niche body 111 and hub 200 of FIGS. 7-9 allows a user to adjust an underwater light to the proper orientation, or a desired orientation, where the niche body 111 is installed in the pool wall at an undesirable orientation. For example, there may be a situation where a user desires the niche 110 to be mounted to the pool wall such that the "top" of the pool light, e.g., the 12:00 position, is at the true 12:00 position when mounted with the niche body 111, but the niche body 111 has been mounted to the wall at an angle 10° clockwise from the 12:00 position. In such a situation, conventional niches prohibit the user from installing the light at the 12:00 position. However, as shown in FIG. 9, the niche body 111 and hub 200 of FIGS. 7-9 allows a user to rotate the hub 200 counter-clockwise 10° to compensate for this "skew" of the body 111. As such, the user can secure the hub 200 to the niche body 111 at the compensated angle so that the light can be mounted with the "top" at the 12:00 position.

Alternatively, a user may desire for the niche 110 to mounted to the pool wall such that the conduit aperture 118 and the angled conduit hub 120 are located at the 3:00 position, allowing the lighting conduit to travel away from the niche body 111 parallel to the plane of the rear wall 116, thus alleviating the need for conduit trenches to be dug. However, the user may nonetheless wish for the "top" of the light 28 to be at the 12:00 position. In a standard niche, a user may be limited. However, the niche body 111 of FIGS. 7-9 allows a user to position the niche body 111, insert and position the hub 120 to the desired orientation for the light, and then insert the light 28 so that it is locked in the desired orientation. The hub 120 allows for greater variety in niche 110 mounting orientations.

The niche 110 of FIGS. 7-9 may be made entirely of a non-metallic components that do not conduct electricity. As such, the niche 110 would not require additional bonding to a pool wall and would not require grounding. Furthermore, the niche 110 may be constructed entirely of components that include no "dead metal" components, e.g., components that include a metal that has no means of electrical connectivity to other metal components, or no means of bonding or grounding. Further, it should be understood that the niche 10 of FIGS. 1-6 or the hub 200 of FIGS. 7-9 can have more or less than four mounting ribs 14, 208. For example, it may have three mounting ribs that are positioned at 120° from each another.

Having thus described the invention in detail, it is to be understood that the foregoing description is not intended to limit the spirit or scope thereof. It will be understood that the embodiments of the present invention described herein are merely exemplary and that a person skilled in the art may make many variations and modification without departing from the spirit and scope of the invention. All such variations and modifications, including those discussed above, are intended to be included within the scope of the invention.

What is claimed is:

1. A pool or spa light niche, comprising:

a back wall including an aperture for receiving a power cable of a pool or a spa light;

a side wall attached at one end about the periphery of the back wall;

a plurality of mounting ribs attached to an inner surface of the side wall; and means formed in at least one of the plurality of mounting ribs for receiving a locking mechanism of the pool or spa light, the locking mechanism rotationally engaging said means for receiving the locking mechanism in order to lock the pool or spa light in position with respect to the niche.

2. The pool or spa light niche of claim 1, further comprising an electrically non-conductive conduit hub attached to an exterior of the back wall adjacent the aperture.

3. The pool or spa light niche of claim 2, wherein the conduit hub is angled at 45° relative to the back wall of the niche.

4. The pool or spa light niche of claim 3, further comprising a 45° bend elbow conduit connected to the conduit hub for providing a full 90° bend exiting the niche.

5. The pool or spa light niche of claim 1, further comprising four mounting ribs attached to an inner surface of the side wall, and a groove formed in each of the four mounting ribs for receiving the locking mechanism of the pool or spa light, for locking the pool or spa light in position with respect to the niche.

6. The pool or spa light niche of claim 1, wherein the niche is formed entirely of electrically non-conductive material.

7. The pool or spa light niche of claim 1, wherein the niche is formed entirely of non-metallic material.

8. The pool or spa light niche of claim 1, further comprising the pool or spa light including the locking mechanism configured to engage the plurality of mounting ribs.

9. The pool or spa light niche of claim 8, wherein the locking mechanism comprises:

an engagement head;

a body connected to the light;

a stopper configured to engage the plurality of mounting ribs; and a flexible arm including a first end connected to the body and a second end connected to the engagement head, wherein the engagement head is configured to contact the plurality of mounting ribs and flex the flexible arm such that the engagement head can pass across said means for receiving the locking mechanism and releasably engage the mounting rib.

10. The pool or spa light niche of claim 9, wherein the light further comprises an aperture configured to allow insertion of a pin to disengage the engagement head from the mounting rib.

11. The pool or spa light niche of claim 10, wherein the light is not removable from the niche without utilizing the pin.

12. The pool or spa light niche of claim 10, further comprising a trim ring on said light for covering said aperture of said light.

13. A pool or spa light niche, comprising:

a body including a back wall having an aperture for receiving a power cable and a threaded aperture for receiving a screw, and a side wall attached at one end about the periphery of the back wall;

a hub including a back wall having an aperture for receiving the screw and a plurality of mounting ribs attached to the back wall, the hub being rotatable about the screw; and means formed in at least one of the plurality of mounting ribs for receiving a locking mechanism of a pool or a spa light, the locking mechanism rotationally engaging said means for receiving the locking mechanism in order to lock the pool or spa light in position with respect to the niche, wherein the screw is insertable through the aperture of the hub and received by the threaded aperture of the body to secure the hub to the body.

14. The pool or spa light niche of claim 13, further comprising an electrically non-conductive conduit hub attached to an exterior of the back wall adjacent the aperture.

15. The pool or spa light niche of claim 14, wherein the conduit hub is positioned at a 45° angle relative to the back wall of the niche.

16. The pool or spa light niche of claim 15, further comprising a 45° bend elbow conduit connected to the conduit hub for providing a full 90° bend exiting the niche.

17. The pool or spa light niche of claim 13, further comprising four mounting ribs attached to an inner surface of the back wall of the hub and a groove formed in each of the four mounting ribs for receiving the locking mechanism of the pool or spa light, for locking the pool or spa light in position with respect to the niche.

18. The pool or spa light niche of claim 13, wherein the niche is formed entirely of electrically non-conductive material.

19. The pool or spa light niche of claim 13, wherein the niche is formed entirely of non-metallic material.

20. The pool or spa light niche of claim 13, further comprising a light including the locking mechanism configured to engage the plurality of mounting ribs.

21. The pool or spa light niche of claim 20, wherein the locking mechanism comprises:

an engagement head;

a body connected to the light;

a stopper configured to engage the plurality of mounting ribs; and a flexible arm including a first end connected to the body and a second end connected to the engagement head, wherein the engagement head is configured to contact the plurality of mounting ribs and flex the flexible arm such that the engagement head can pass across said means for receiving the locking mechanism and releasably engage the mounting rib.

22. The pool or spa light niche of claim 21, wherein the light further comprises an aperture configured to allow insertion of a pin to disengage the engagement head from the mounting rib.

23. The pool or spa light niche of claim 13, further comprising a rotation index provided on the back wall of the body and a window provided through the back wall of the hub, wherein at least a portion of the rotation index is viewable through the window when the hub is attached to the body.

* * * * *